United States Patent [19]

Marson

[11] Patent Number: 4,772,907

[45] Date of Patent: Sep. 20, 1988

[54] UNIT FOR COLLECTING DEVELOPED FILMS IN A FILM DEVELOPING MACHINE, PARTICULARLY OF INDUSTRIAL KIND

[75] Inventor: Roberto Marson, Pordenone, Italy

[73] Assignee: Gretag San Marco S.p.A., Fiume Veneto, Italy

[21] Appl. No.: 27,821

[22] Filed: Mar. 19, 1987

[30] Foreign Application Priority Data

Mar. 24, 1986 [IT] Italy ..... 45714 A/86

[51] Int. Cl.[4] ..... G03D 3/13; G03D 13/00

[52] U.S. Cl. ..... 354/319; 354/339; 226/92; 226/196

[58] Field of Search ..... 354/316, 319, 320, 321, 354/322, 338, 339, 344; 226/91, 92, 188, 189, 196

[56] References Cited

U.S. PATENT DOCUMENTS

| | | | |
|---|---|---|---|
| 1,525,363 | 2/1925 | Boyce . | |
| 2,124,106 | 7/1938 | Dye | 354/322 |
| 2,928,329 | 3/1960 | Limbach . | |
| 3,033,351 | 5/1962 | Dutch . | |
| 3,087,406 | 4/1963 | Dutch . | |
| 3,610,130 | 10/1971 | Langkopf | 354/322 |
| 3,656,676 | 4/1972 | Hope et al. | 226/92 |
| 4,045,809 | 8/1977 | Landers | 354/322 |

FOREIGN PATENT DOCUMENTS

| | | |
|---|---|---|
| 0158806 | 10/1985 | European Pat. Off. . |
| 1810004 | 5/1970 | Fed. Rep. of Germany . |

*Primary Examiner*—A. A. Mathews

*Attorney, Agent, or Firm*—Wenderoth, Lind & Ponack

[57] ABSTRACT

A film accumulating device for a film developing machine of an industrial kind in which the films are entrained by leaders. The collecting unit is situated at the outlet side of the developing machine and includes a box-like envelope (9), a series of pairs of rollers (19, 20) supported in the envelope which drive the leaders and the subsequent films connected thereto toward a subsequent roller (32). Two lateral guide supports (33, 34) deflect the leaders upwardly into guide slots (16) of lateral forks (10, 11), which are substantially extended from the end portion of the box-like envelope (9). When the leaders are completely disengaged from the roller (32) and the relative lateral guide supports (33, 34) they fall into recesses (17, 18) provided at the lower ends of the lateral forks (10, 11) and the trailing ends of the leaders are laterally supported by such recesses (17, 18). The subsequent films, which are pushed by the pairs of rollers (19, 20), are progressively folded as they are fed out from an opening provided in the lower side of the box-like envelope (9), between the lateral forks, (10, 11), until they are vertically extended and hung from the respective leaders which are collected progressively within the guide slots (16).

20 Claims, 6 Drawing Sheets

UNIT FOR COLLECTING DEVELOPED FILMS IN A FILM DEVELOPING MACHINE, PARTICULARLY OF INDUSTRIAL KIND

BACKGROUND OF THE INVENTION

1. Field of the Invention

The invention relates to a unit for collecting developed films, which is used in correspondence with the terminal part of a film developing machine, particularly one of an industrial kind.

2. Description of the Prior Art

As it is known, the film developing machine utilized in the industrial field for developing laboratories and the like are substantially constituted by a series of separated treatment tanks, containing the various conventional chemical substances which are required for developing films, as well as by transport means such as suitable conveying pinions and entrainment rollers, etc., in order to effect the subsequent passage of these films through all the tanks and a following drying zone, until the so developed and dried films arrive in correspondence with a collecting unit, from which they may be drawn.

In order to pass the films through the developing machine, they are previously attached onto respective leaders by means of a tape or adequate adhesive substances, wherein each leader is constituted by a thin flexible sheet made of a conventional plastic. The leaders are provided with a series of holes, which are reciprocally aligned and equally spaced for permitting the conveying pinions to be engaged therein and therefore permitting each leader and the films to be entrained through the machine, wherein the films are also entrained by the above described entrainment rollers.

In turn, the unit for collecting developed films is disposed in correspondence with the terminal part of the developing machine and generally is shaped in such a manner as to permit a series of leaders together with the respective films to be stored automatically therein.

There is a known collecting unit comprising a series of rollers which are reciprocally opposite and adjacent and shaped for determining the entrainment of each leader by means of the engagement of the same rollers with corresponding holes, which are provided in a central position of the leader, as well as for effecting the frictional entrainment of the films which are connected to such a leader.

In addition, the collecting unit referred to is provided with at least a guide baffle constituted by a portion of a sheet, which is inclined upwardly and disposed within the sliding path of each leader together with the respective films, in a manner such that as soon as the leaders arrive in correspondence with the sheet, they are deflected in the same upwardly inclined direction, thus accumulation within a box able to store a definite number of leaders.

To this aim, the box referred to is provided in its inner side with a protruded tongue, which is inclined upwardly and situated at a level higher than that of the baffle and which is also provided in a position corresponding to that of the holes of the leader.

In this manner, as soon as the leader arrives in front of the tongue, the latter engages itself with a corresponding hole of the leader and consequently this leader is hooked in position without the possibility of being shifted therefrom.

In turn, the continuous rotation of the rollers determines a steady advancement of the films in the same direction of the leader. However, due to the fact that the films are more flexible than the leader and are not guided by the baffle, these films are folded downwardly and progressively stored in a vertical direction within a proper container, which is placed in a position below the box.

Likewise, each subsequent leader is hooked to the tongue and stacked over the previous leaders which are always hooked in position, while the corresponding films of such a leader are all introduced within the container, in the same manner which has been previously described.

Then, the whole series of leaders, together with the films connected to the same, is detached from the tongue and extracted from the box. Once emptied, the box is again applied onto the developing machine and is ready for permitting other leaders to be stored therein.

SUMMARY OF THE INVENTION

The invention makes it possible to have a system for collecting the developed films and the respective leaders thereof, which is more simple, rational and reliable than the systems known from the state of the art, for any operating condition of the same machine and for any leader which is employed, either with a central hole or holes which are provided in different positions thereof as well as those without any hole or holes.

These and other objects are obtained, according to the invention, by means of a unit for collecting developed films in a film developing machine, in particular of an industrial kind, the collecting unit being provided at the end portion of the machine and comprising a series of opposed spring biased rollers, which are driven in rotation in a per se known manner for the entrainment and the guiding of the films and the respective leader thereof, to which the films are connected, in such a way that the films are folded and fall gradually into a container disposed below the same for permitting the films to be collected therein.

The collecting unit is characterized in that the series of rollers is associated with at least a further spring roller, which is driven in rotation in a per se known manner and is disposed near at least a one fork element having two lateral forks directed upwardly, the further roller co-operating with guide supports in such a manner as to determine an upward movement of the said leader and then the falling thereof within the lateral forks, from which the leader is supported.

BRIEF DESCRIPTION OF THE DRAWING

The following description, given by way of a non limiting example only, makes evident the features of the invention, referring to the enclosed drawings in which.

DETAILED DESCRIPTION OF THE PREFERRED EMBODIMENT

Figure 1:
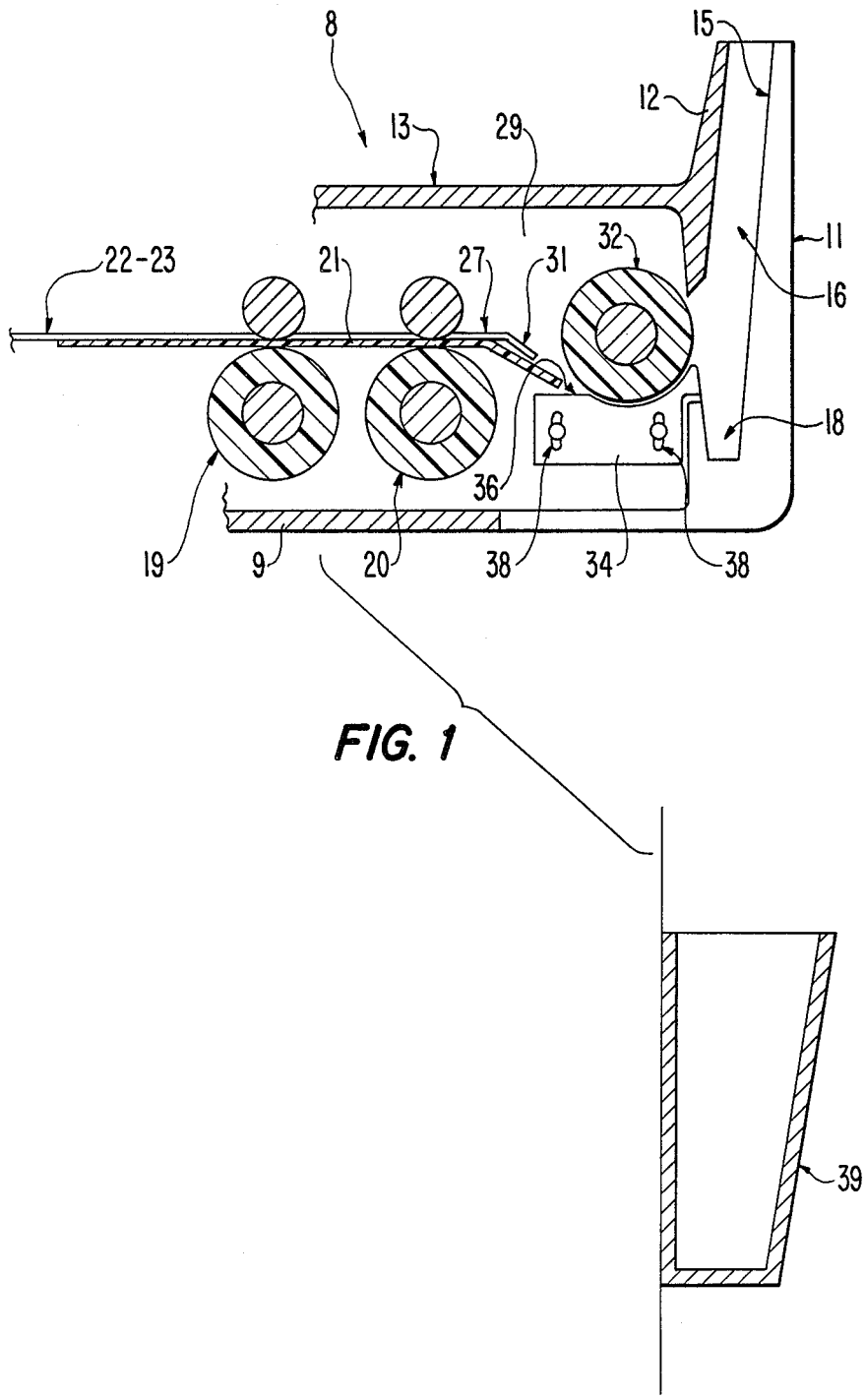
FIGS. 1–5 show, in a lateral cut view, the unit according to the invention for collecting developed films in five different and subsequent operating positions.
Figure 7:
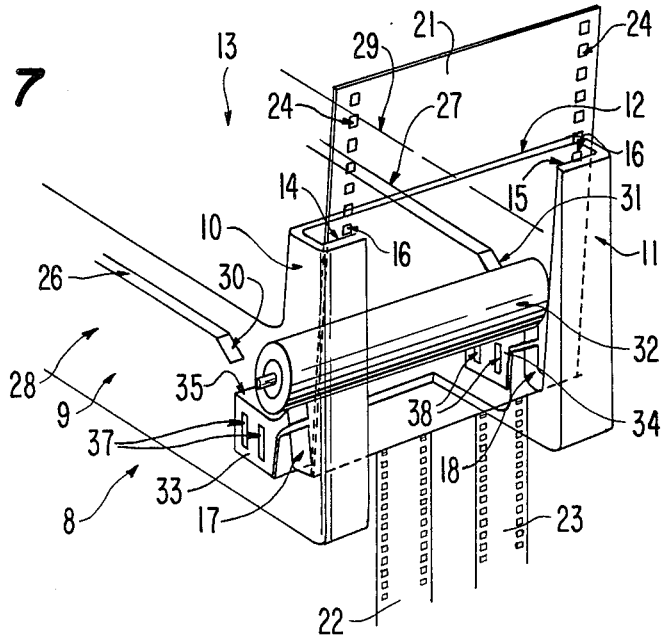
FIG. 7 shows a perspective view of the collecting unit according to the invention.

Referring to FIGS. 1 and 7, there is shown a unit or device 8 for accumulating or collecting developed films, which is provided at the end portion of a conventional film developing machine of the industrial kind (not shown).

In particular, such an unit comprises a box-like envelope 9 whose end portions are provided with a fork element having two lateral forks 10 and 11, directed upwardly and disposed parallel and spaced from each other in a lateral direction.

Moreover, both of the forks are connected to a vertical portion of a flat wall 12, which in turn is connected to an upper wall 13 of the box-like envelope 9 for the whole distance of the forks, the flat wall 12 being spaced by a certain amount from corresponding inclined walls 14 and 15 of the respective lateral forks 10,11 so as to define a respective guide slot 16 for accommodating a predetermined number of leaders, as it will be hereinafter described.

Finally, the lateral forks 10 and 11 are each provided with a respective recess 17 and 18, defining a lower portion of each corresponding guide slot 16 and constituting comprising a support means formed by a lower flat support surface extending from a respective wall 14, 15 for permitting the leaders which are introduced within the guide slots to be laterally supported thereon. In addition, driving means comprising pairs of spring biased rollers 19 and 20 which are driven in rotation in a per se known manner extend horizontally within the box-like envelope 9, which rollers are constituted by opposed rollers, disposed adjacent each other, in order to allow each leader together with the developed films, connected in a conventional manner thereto, to pass therebetween.

Figure 6:
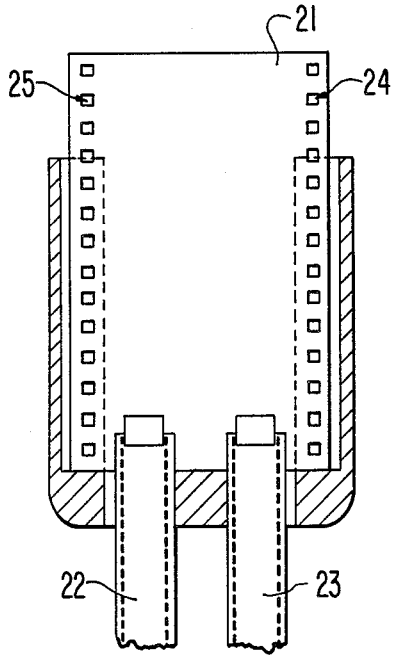
FIG. 6 shows the unit of FIG. 1, cut along the line I—I.

In this embodiment, a leader 21 is shown together with two films 22,23 connected thereto (see FIG. 6), this leader being provided at the each side thereof with a respective row of holes 24,25, which are reciprocally aligned and spaced, for permitting the corresponding teeth (not shown) of the feeding rollers of the machine to be engaged therein, thereby obtaining the entrainment of the leader and the films.

In correspondence with the above described pairs of rollers there can be provided two lateral guides 26,27, which are fitted against inner surfaces of respective lateral walls 28,29 of the box-like envelope 9, each of the guides being so shaped as to present a respective downwardly inclined portion 30,31, which is able to change the sliding path of each leader and the respective films thereof, by diverting them toward a gap formed between a further spring biased roller 32 forming part of the driving means, which also extends horizontally within the box-like envelope 9, and deflection means comprising a respective guide support 33,34, each of which is provided at the one end of the roller 32 and extends inwardly from a respective lateral wall 28,29 of the box-like envelope 9.

In particular, the roller 32 is disposed so as to be driven in rotation, in a conventional manner, near the guide slot 16 of each lateral fork 10,11, while the guide supports 33,34 are disposed beneath the roller 32 and provided with a respective upper surface 35,36, each of which is initially downwardly inclined at the entrance to the roller 32 so as to accommodate each leader together with the respective films thereof, which are fed from the pairs of rollers 19 and 20, and then upwardly inclined at the exit of the roller 32 so as to transfer them into the respective guide slot 16 previously described, due to the entrainment of the same by means of the rotating roller 32.

In addition, the guide supports 33,34 are provided with respective vertical slots 37,38 for permitting a limited adjustment of the distance and the inclination of the supports 33,34 with respect to the roller 32, depending on the thickness of the leaders, and to change and adapt both the inlet opening and the outlet inclination thereof. It will be noted that suitable fasteners extend from the walls 28, 29 into the slots 37, 38 to allow this adjustment, as shown in FIGS. 1–5.

Finally, at least a container 39 which is adequately dimensioned for receiving a determinate amount of developed films, which are fed out from the developing machine, is disposed beneath the collecting unit 8.

Referring now to the FIGS. 1–5, there are shown the different operating positions of each leader together with the respective films thereof, when they are fed through the collecting unit according to the invention.

In FIG. 1 it is to be noted that the leader 21 is entrained toward the outlet side of the pair of rollers 20 and diverted slightly downwardly, by the effect of the downwardly inclined portions 30,31 of the respective lateral guides 26,27, in the direction of the inclined surfaces 35,36 of the relative guide supports 33,34, which surfaces are situated beneath the inclined portions 30,31 faces are situated beneath the inclined portions 30, 31.

Figure 2:
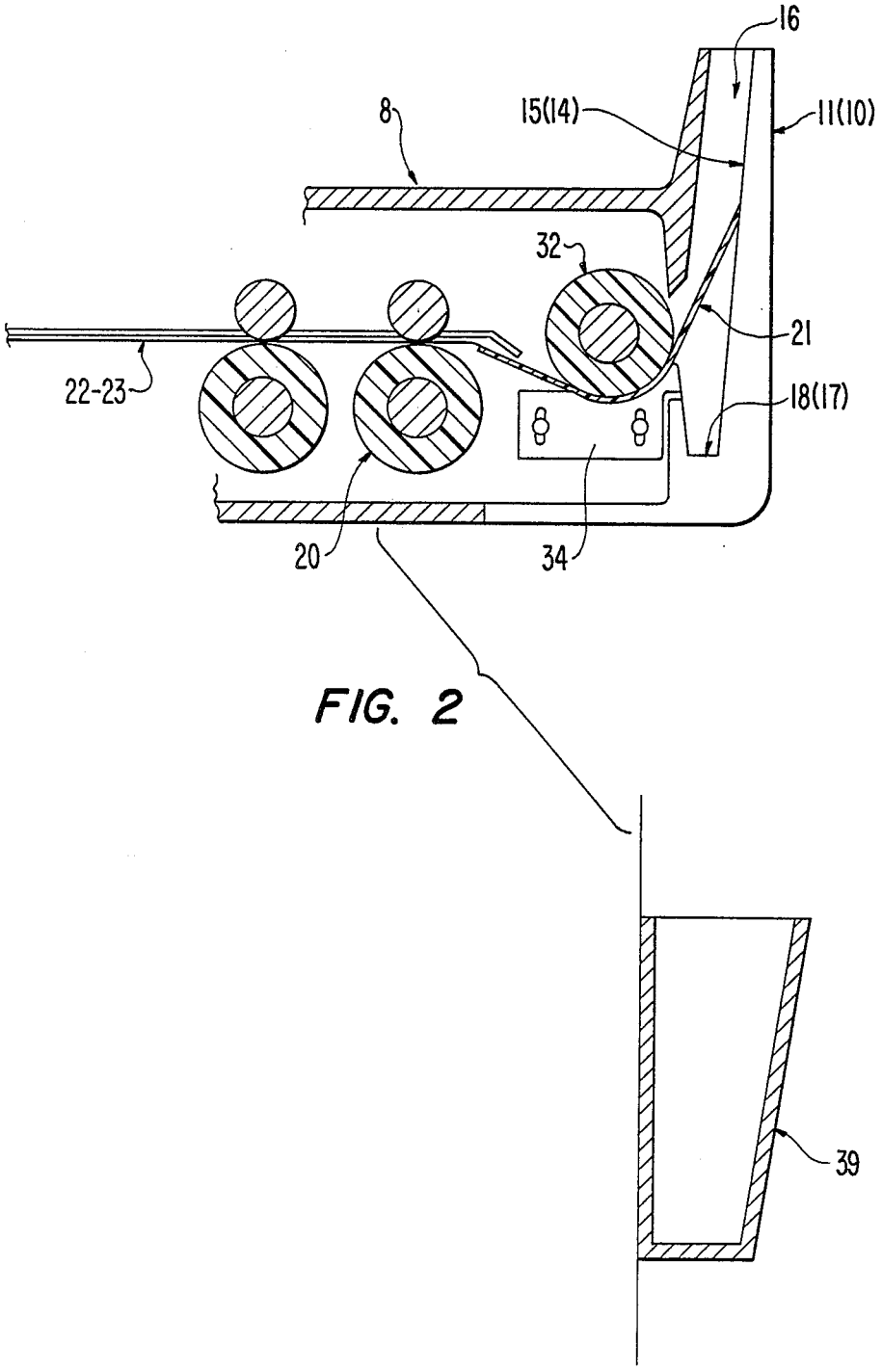
Figure 3:
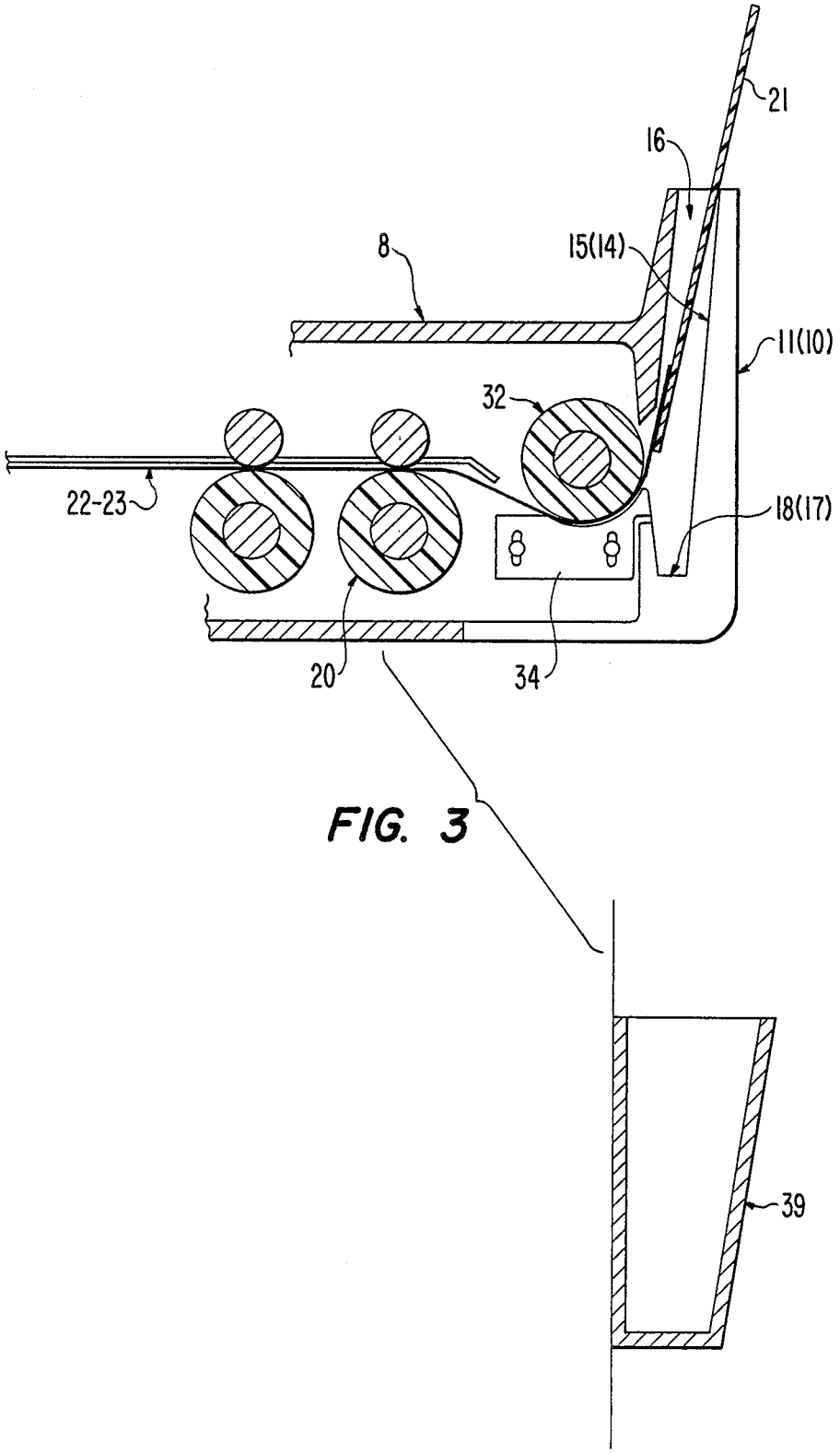
Figure 4:
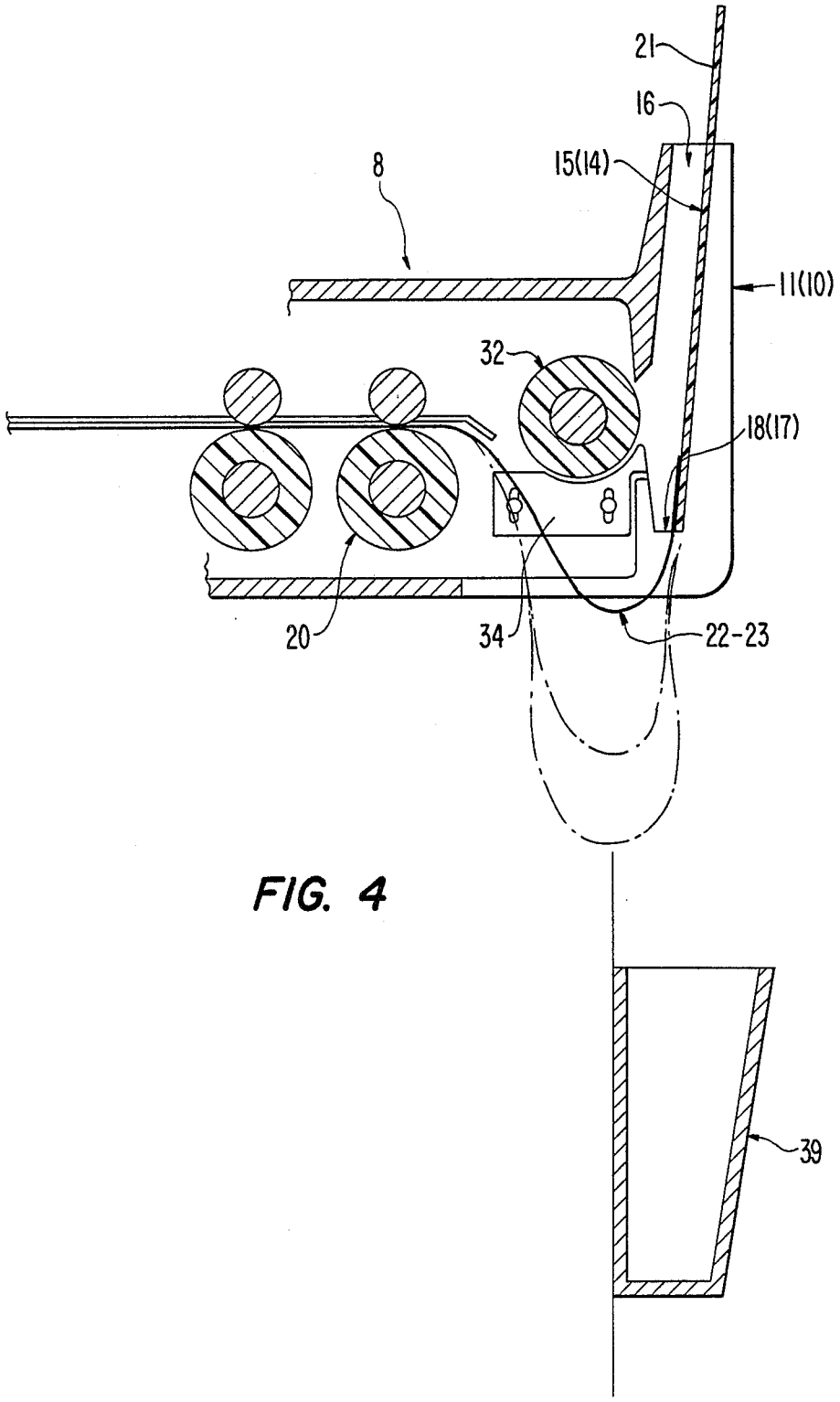

In FIG. 2 is it to be noted that the leader 21, by passing through the gap existing between the guide supports 33,34 and the rotating roller 32, is fed upwardly by the latter so that the lateral edges of the leader arrive into each guide slot 16 of the respective lateral forks 10 and 11, and are placed against the respective inclined walls 14 and 15 of the forks. In FIG. 3 it is to be noted that the leader 21, by sliding progressively upwardly against the inclined walls 14,15, is raised to such a position that it becomes completely disengaged from the roller 32, making it possible to be shifted to the subsequent position of FIG. 4, due to the action of gravity and the weight of the films which are still entrained by roller pair 19,20, in which position the leader is supported against both recesses 17 and 18 as well as the inclined surfaces 14,15 of the respective lateral forks 10,11.

In addition, since the leader 21 is supported by the forks 10,11 in the above described manner without any possibility of falling down, as its lower part is supported laterally by the recesses 17,18, while on the contrary the films which are connected to such a leader (in FIGS. 1–5 there is shown at least one film 22) are continuously entrained by the different rollers of the inventive collecting unit, for the whole length thereof, it follows that in the latter position such films are progressively folded and shifted downwardly (which films are drawn with a dashed line in FIG. 4) and, after passing through the free space comprised between the lateral forks 10,11, they gradually arrive inside the container 39.

Figure 5:
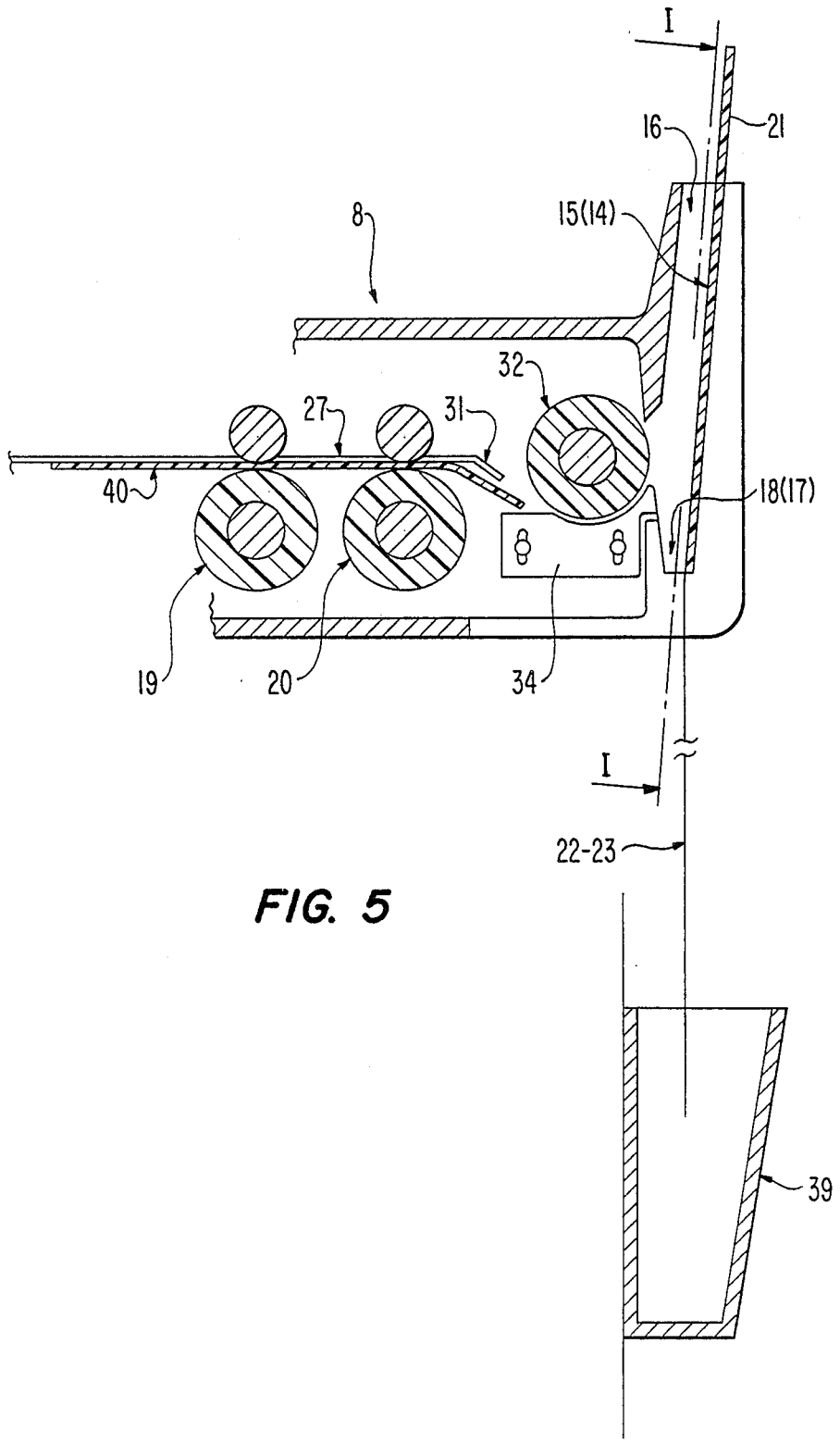

Finally, in the FIG. 5 it is to be noted that such films are completely disengaged from the rollers of the collecting unit 8, in such a way that the film portion which is connected to the leader 21 can be extended vertically. In this position, it is to be noted also that a subsequent leader 40 is entrained by the rollers of the collecting unit 8 in the same operating position of FIG. 1, which was assumed by the former leader 21.

Therefore, such a leader and all the subsequent ones will be reciprocally accumulated side-by-side, by overlapping themselves until the guide grooves 16 of the lateral forks 10 and 11 are completely filled, while the films which are connected to each leader will be collected within the container 39 located below in the same manner which has been already described.

As soon as the guide grooves 16 are completely filled up, a suitable signaling means may be provided for automatically stopping the operation of the collecting unit 8, thereby permitting the operator to remove the leaders which have been collected therein.

The film removal occurs either by lifting the leaders from the unit 8 or by bending them at a central position during their extraction, so that the bundle of collected leaders may be removed from the unit 8 to permit the subsequent required operations to be carried out. Thus, the advantages of the present collecting unit with respect to the previously described unit should now be evident.

In fact, since this collecting unit does not require the hooking of the leaders in a superimposed position thereof, as was previously foreseen, it is possible to avoid improper or unstable positioning of the leaders and thus avoid damaging the films which are connected to such leaders.

Although the present invention has been described with reference to the foregoing embodiment, it will be understood by those skilled in the art that various changes and modifications may be made thereto which fall within the scope of the appended claims.

I claim:

1. A film accumulating device which can be supported at the rear of a film developing apparatus to accumulate developed films, comprising:

driving means for pulling a leader having a film attached thereto out of the developing machine, the leader having a leading end and a trailing end with the film extending from the trailing end of the leader;

guide means for guiding the leader in an upward direction as the leader is fed out of the driving means; and support means for engaging the trailing end of the leader after the trailing end of the leader has been fed out of the driving means so that the leader is supported by the support means.

2. A film accumulating device according to claim 1, wherein said support means is sized to support a plurality of leaders fed out of the driving means.

3. A film accumulating device according to claim 1, wherein said guide means comprises at least one guide wall which engages a lateral edge of the leader therein and guides the leader in the upward direction.

4. A film accumulating device according to claim 1, further comprising a deflecting means disposed between the driving means and the guide means for deflecting the leader upwardly into engagement with the guide means.

5. A film accumulating device according to claim 1, wherein the guide means comprises guide wall means for engaging both lateral edges of the leader and guiding the leader in the upward direction.

6. A film accumulating device according to claim 5, wherein the guide wall means comprises a pair of spaced-apart forks, each of the forks having a guide wall facing the other one of the forks.

7. A film accumulating device according to claim 6, wherein the guide wall of each of the forks is an upwardly inclined wall formed by a guide slot in each of the forks.

8. A film accumulating device according to claim 3, wherein the support means comprises a support surface extending from a lower end of the guide wall.

9. A film accumulating device according to claim 6, wherein the support means comprises a support surface extending from a lower end of each of the guide walls.

10. A film accumulating device according to claim 4, wherein the driving means includes at least one driven roller and the deflection means is disposed adjacent the driven roller to define a gap therebetween through which the leader is fed.

11. A film accumulating device according to claim 10, wherein the deflection means is movable towards and away from the driven roller for adjusting the size of the gap between the driven roller and the deflection means.

12. A film accumulating device according to claim 11, wherein the deflection means comprises a pair of spaced-apart guide supports, each of the guide supports including an upwardly inclined surface for deflecting the leader upwardly into engagement with the guide means.

13. A film accumulating device according to claim 1, wherein the device includes a box-like envelope including a pair of spaced-apart lateral walls extending in a longitudinal direction, the driving means comprising a driven roller rotatably supported between the lateral walls, the guide means comprising at least one upwardly inclined guide wall extending inwardly from one of said lateral walls in a transverse direction toward the other one of the lateral walls, the support means comprising at least one support surface extending in the longitudinal direction along one of the lateral walls and facing the other one of the lateral walls.

14. A film accumulating device according to claim 13, wherein at least one upwardly inclined guide wall comprises a pair of guide walls, each of which extends inwardly from a respective one of the lateral walls in a lateral direction towards the other one of the lateral walls, and the at least one support surface comprises a pair of support surfaces, each of which extends in the longitudinal direction along a respective one of the lateral walls and faces the other one of the lateral walls.

15. A film accumulating device according to claim 14, further comprising at least one pair of rollers disposed between the lateral walls, one of the rollers being rotatable and spring biased towards the other one of the rollers for conveying the leader and film towards the guide means.

16. A film accumulating device according to claim 15, further comprising at least one downwardly inclined surface extending in the transverse direction along one of the lateral walls and facing the other one of the lateral walls, the downwardly inclined surface being disposed at a position between the pair of rollers and the driven roller for diverting the leader into driving engagement with the driven roller.

17. A film accumulating device according to claim 16, further comprising deflecting means having a portion thereof disposed between the driven roller and the upwardly inclined guide walls for deflecting the leader upwardly into engagement with the guide walls, the deflecting means being disposed adjacent the driven roller to define a gap there-between through which the leader is fed.

18. A film accumulating device according to claim 17, wherein the deflecting means includes another portion thereof disposed between the driven roller and the downwardly inclined surface for deflecting the leader into the gap between the driven roller and the deflecting means.

19. A film accumulating device according to claim 1, wherein the guide means comprises a pair of spaced-apart guide grooves facing each other and formed in a pair of spaced-apart lateral walls, the support means comprising a pair of spaced-apart recesses formed in the lateral walls and connected to the guide grooves so that the leader can be received in the guide grooves and fall by gravity into the recesses after the trailing end of the leader has been fed out of the driving means.

20. A film accumulating device according to claim 19, wherein the guide grooves are open at the top thereof for removal of the leader and film attached thereto by withdrawing the leader upwardly through the open tops of the guide grooves.

* * * * *